United States Patent [19]

Gott et al.

[11] 4,117,872

[45] Oct. 3, 1978

[54] BINDING TOOL

[75] Inventors: Hans Gött; Josef Ritter; Klaus Ritter; Gerhard Ritter, all of Graz, Austria

[73] Assignee: EVG Entwicklungs- u. Verwertungs-GmbH., Graz, Austria

[21] Appl. No.: 799,522

[22] Filed: May 23, 1977

[30] Foreign Application Priority Data

May 25, 1976 [AT] Austria ..... 3830/76

[51] Int. Cl.[2] ..... B21F 15/04

[52] U.S. Cl. ..... 140/57; 140/93.6; 140/119

[58] Field of Search ..... 140/57, 93 A, 119, 93.6, 140/118, 122, 149; 100/25, 26, 31

[56] References Cited

U.S. PATENT DOCUMENTS

| | | | |
|---|---|---|---|
| 1,320,515 | 11/1919 | Warwick | 140/93 A |
| 3,391,715 | 7/1968 | Thompson | 140/93.6 |

FOREIGN PATENT DOCUMENTS

| | | | |
|---|---|---|---|
| 344,698 | 4/1960 | Switzerland | 140/93.6 |

*Primary Examiner*—Lowell A. Larson
*Attorney, Agent, or Firm*—Ernest F. Marmorek

[57] ABSTRACT

The invention relates to a binding tool for twisting the free ends of a binding wire, particularly for holding together metal reinforcing rods at their crossover points. The tool has a feed device for the binding wire, at least one pair of wire guides which can be opened and closed like pincers and which form, in the closed state, a U-shaped wire guide path, in use, around an assembly to be bound, shears for cutting the advanced wire to length and a twisting head which can be driven and which has wire passages to receive the ends of the wire to be twisted, the wire feed path extending, when the twisting head is in the position of rest, through one wire passage therein and, via the U-shaped wire guide path into the other wire passage in the twisting head. The twisting head is disposed in the space between the wire guides of the or each pair and the wire passages in the twisting head are formed in components which can be swung inwards about bearing pins.

6 Claims, 5 Drawing Figures

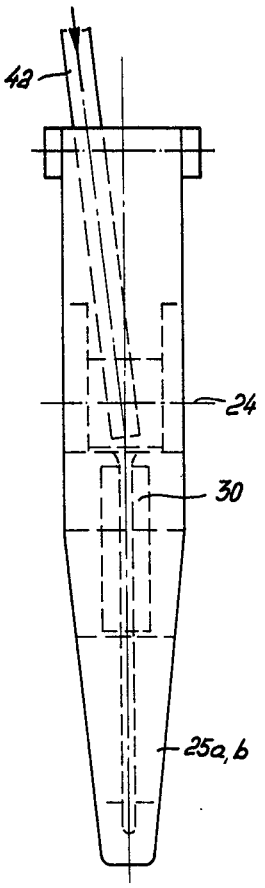
FIG. 4
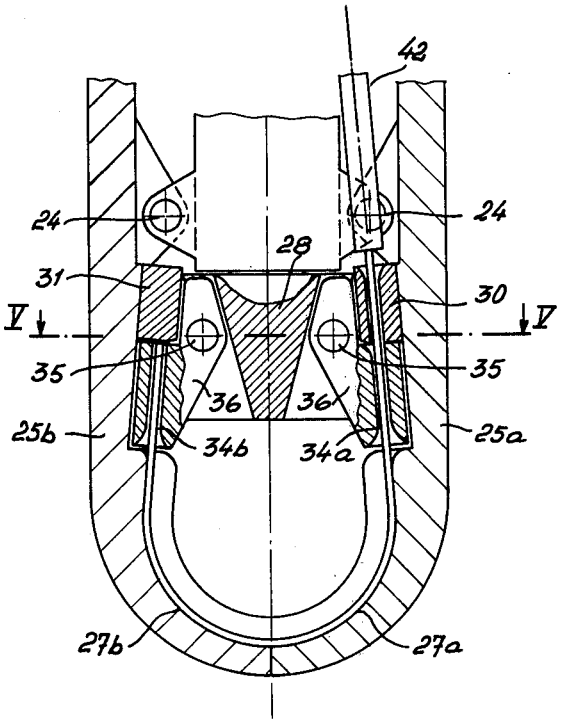
FIG. 3
FIG. 5
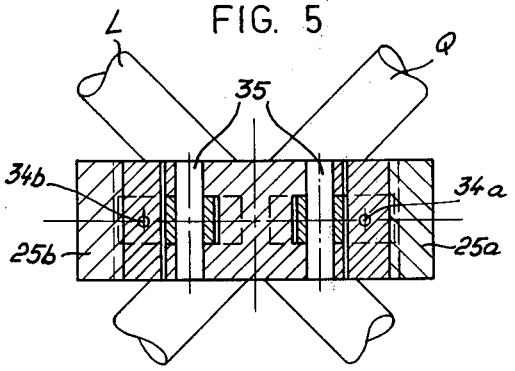

BINDING TOOL

The invention relates to a binding tool for twisting the free ends of a binding wire, such as for binding crossed reinforcing rods for reinforced concrete, the tool having a feed device for the binding wire, at least one pair of wire guides which can be opened and closed like pincers and which form in the closed state a U-shaped wire guide path, in use, around an assembly to be bound, shears for cutting the advanced wire to length and a twisting head which can be driven and which has wire passages to receive the ends of the wire to be twisted, the wire feed path extending, when the twisting head is in position of rest, through one wire passage therein and, via the U-shaped wire guide path into the other wire passage in the twisting head. Such binding tools, which are hereinafter referred to as of the kind described, can be used for the most varied purposes and, in particular, can be used for binding crossed reinforcing rods for reinforced concrete by means of binding wire.

In certain circumstances it is known to be advantageous or even necessary to connect the longitudinal and transverse rods of reinforcing grids for reinforced concrete at their points of intersection, not in the usual manner by electric resistance welding but by other means, particularly by binding together with wires. This applies, in particular, when grid rods of naturally hard alloyed steels are used, which can only be connected to one another by electric resistance welding with difficulty and unsatisfactorily particularly when it is a question of hot-rolled rods, such as ribbed rods with a layer of scale. Since any detraction from the quality of the steel is avoided when using the binding technique, in contrast to welding, bound reinforcing grids can also be used for cases of dynamic loading, for example for the slabs of bridge carriage-ways, and finally, bound meshes can also be produced when no adequate electrical energy is available for the resistance welding, such as directly at the building site, where it is particularly a question of producing bound grids of particularly thick rods of particularly large dimensions.

A binding tool of the kind described is known from the German published patent application DOS No. 1,752.554 and has the advantages over binding tools of the kind known from the U.S. Pat. No. 3,211,187, wherein two twisting heads which can be driven in opposite directions each twist the ends of two binding wires together, simultaneously and in pairs, for the purpose of forming a loop; in that the tool is simpler in construction and also easier to handle and that a wire twist is only formed at one side of each loop and can easily be bent so that it bears closely against the parts connected to one another by the loop to avoid any risk of injury.

In the binding tool known from DOS No. 1,752,554, the twisting head is formed by a clamping ring with a frusto-conical cavity and a frusto-conical clamping disc which fits into this and between them they grip the two ends of the length of binding wire already bent into U-shape in the binding tool during the twisting operation. The twisting head shown is disposed outside and above the pincer-like wire guides.

The arrangement of the twisting head above the pincer-like wire guides necessitates the use of unnecessarily long wires for the binding operation because the binding wire wrapping round the members to be connected, at the bottom, has to be taken beyond the bearing positions of the pincer-like wire guides up to the elevated twisting head. This circumstance leads to a large consumption of wire for each individual binding operation. Furthermore, complicated guides are necessary on the one hand in order to hold the binding wire under control over the long feed path and on the other hand to release it again at the correct moment for the binding operation. Finally, the twisting head, which is relatively far away from the members to be connected, cannot twist the two projecting and gripped ends of the wire completely together, so that two relatively long, untwisted, V-shaped projecting ends remain on the twist of each loop and may easily lead to injury during the handling of the connected members.

The object of the invention is therefore to construct a binding tool of the kind described so that the binding wires are twisted to such an extent that scarcely any harmful projecting length remains on the wire twists, while at the same time the construction is simplified.

According to the invention, in a binding tool of the kind described, the twisting head is disposed in the space between the wire guides of the or each pair and the wire passages in the twisting head are formed in components thereof which can be swung inwards about bearing means.

Because of the position of the twisting head immediately in the gap between the pincer-like wire guides, such a binding tool manages with considerably shorter binding wires and in addition, because of the components which can be swung inwards and which contain the wire-receiving passages, it can twist the ends of the wire substantially completely together to form a twist.

As explained more precisely below, the binding tool can be adapted for automatically cutting the binding wire to length, for the simultaneous production of two binding loops and for the automatic initiation of the twisting operation after termination of the wire feed. Furthermore, binding tools of this kind can also be used in grid binding machines.

Two examples of a binding tool constructed in accordance with the invention are illustrated in the accompanying drawings in which:

FIGS. 3 and 4 show the lower portion of another form of tool, likewise in front and side elevation respectively, partially in section; and, FIG. 5 is a section of the line V—V in FIG. 3 through the lower tool portion in the correct relative position to crossed reinforcing rods.

Figure 1:
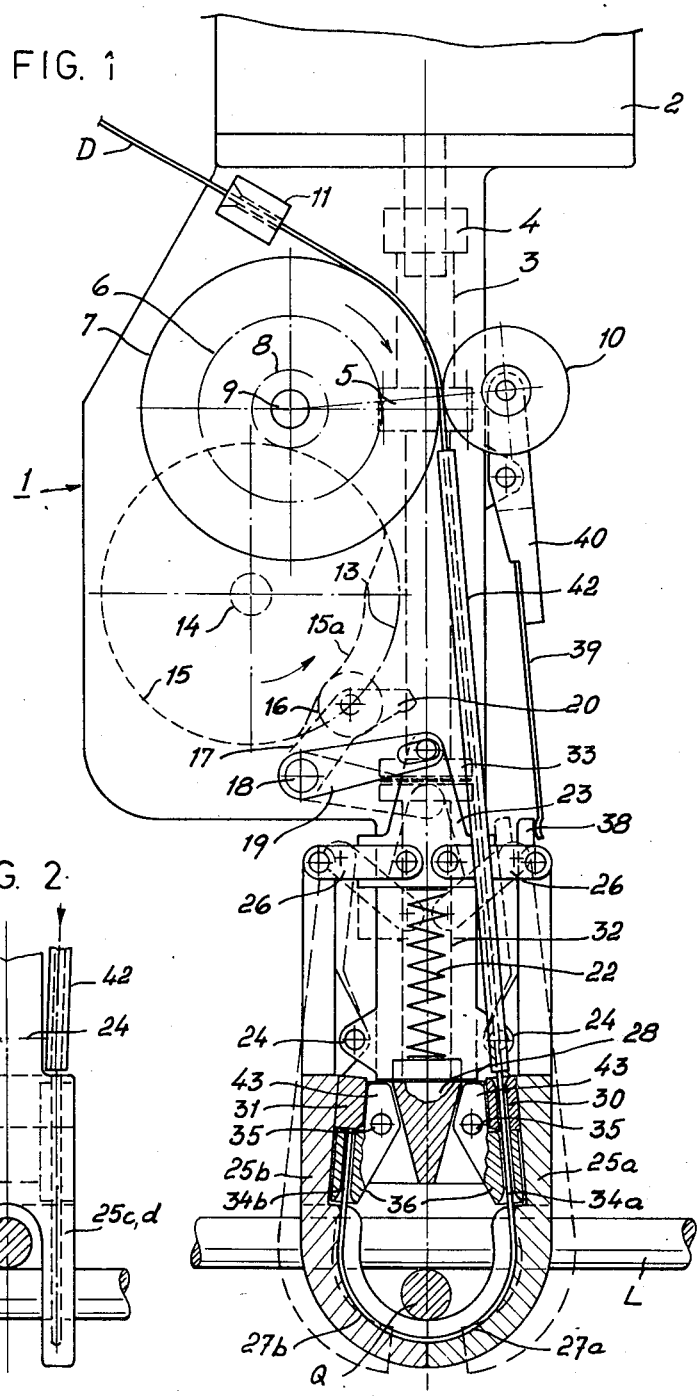
FIG. 1 shows one binding tool in a front view, partially in section.
Figure 2:
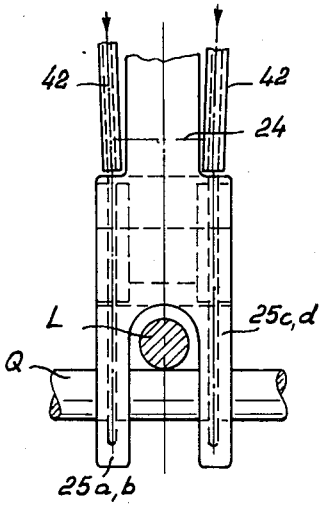
FIG. 2 shows the lower portion of this tool, in side elevation.

In the binding tool shown in FIGS. 1 and 2, disposed at the top of a tool housing designated in general by 1 is a drive motor 2 of which the shaft forming the main shaft 3 of the tool is made telescopic over a short length at 4 so that it can execute a limited axial displacement in relation to the motor 2.

Driven by a worm gear 5, 6 from the main shaft 3 is, on the one hand a conveying pulley 7 situated outside the housing 1 and, on the other hand, a gearwheel 8 disposed inside the housing 1, both of which are connected to the same shaft 9 as the worm wheel 6, for joint rotation therewith. The conveying pulley 7 has a groove periphery and serves, in cooperation with a pressure roller 10, to supply a binding wire D passing through a guide passage 11 to the active part of the binding tool.

The gearwheel 8 is in mesh with a second gearwheel 13 which is mounted, together with a camplate 15 of substantially the same size, on a shaft 14 journalled in the housing 1, for joint rotation therewith. The follower roller 16 of the camplate 15 is mounted on a lever 17 which is keyed, together with a second lever 19 disposed outside the housing 1, on a common shaft 18. The free end of the lever 19 is articulately connected, through a fork, to a substantially T-shaped sliding member 23 which is guided for sliding laterally outside the housing 1 in the axial direction of the shaft 3 and is loaded by a spring 22 in such a direction that the follower roller 16 is urged against the periphery of the camplate 15.

Two wire guides **25*a*, 25*b* which are constructed in the form of two-armed half U-shaped levers and which can be opened and closed like pincers are articulated on two hinges 24 secured to the housing 1. The lower arms of the wire guides 25*a*, 25*b* are bent in a semicircle and comprise, at their inner faces, aligned U-shaped channels 27*a*, 27*b* to receive sections of the binding wire D supplied. The upper arms of the wire guides 25*a*, 25*b* are articulately connected to the sliding member 23 at their ends by means of draw-rods 26. A guide nozzle 30 is provided on the lower arm of the wire guide 25*a* while a stop member 31 is disposed at the corresponding point on the lower arm of the wire guide 25*b*. As can clearly be seen from FIG. 1, the guide nozzle 30 and the stop member 31 lie immediately below the hinges 24. A twisting head, designated in general by 28, is disposed between the two lower arms of the wire guides 25*a*, 25*b*, curved in a pincerlike manner. The twisting head 28 is mounted on a shaft 32, for joint rotation therewith, which shaft can be coupled to the main shaft 3 through a friction clutch 33. This friction clutch 33 can be engaged by a projection 20 on the lever 17**, already mentioned.

Associated with each binding wire D in the twisting head are two receiving passages **34*a*, 34*b* which are formed in components 36 which can be swung inwards about bearing pins 35. These components 36 are likewise substantially constructed in the form of two-armed levers, the lower lever arms containing the receiving passages 34*a*, 34*b* and the upper lever arms 43 cooperating with the guide nozzle 30 or the stop member 31 of the wire guides 25*a*, 25*b* in such a manner that, when the binding tool is in the closed position shown in FIG. 1, the receiving passage 34*a* is in alignment with guide nozzle 30 at the inlet side and with the channel 27*a* of the wire guide 25*a* at the outlet side and the receiving passage 34*b* is in alignment with the channel 27*b* of the wire guide 25*b* at the inlet side and is covered by the stop member 31** at the outlet side.

It can also be seen in FIG. 1 that the wire guide **25*a* comprises a projection 38 above the point of articulation of the draw-rod 26, which projection presses against a leaf spring 39 which in turn is secured to one arm of a two-armed lever 40. Mounted on the other arm of the two-armed lever 40 is the pressure roller 10, already mentioned, which cooperates with the conveying pulley 7 to push the binding wire D into a guide tube 42. This guide tube 42 is pivotally mounted, in a manner not illustrated, so that it can follow the movements of the guide nozzle 30** without damaging the binding wire D.

Fundamentally, two constructions of the binding tool are possible, which are alike in their mode of operation but differ only in detail. According to FIGS. 1 and 2, four wire guides **25*a*, 25*b* and 25*c*, 25*d*** cooperating in pairs are associated with each rod crossing point to be connected so that two binding wires D are supplied simultaneously at each rod crossing point and are bent into U-shaped loops, the two loops being formed at each side of one of the two rods L and Q to be connected, for example of rod L, in planes which are normal to the second of the two rods to be connected, for example Q.

The second example of the binding tool is illustrated diagrammatically in FIGS. 3, 4 and 5. Here only two wire guides **25*a*, 25*b* are associated with each rod crossing point and only one wire loop is formed at each rod crossing point, the plane of which, according to FIG. 5**, intersects each of the two rods L and Q crossing one another and to be connected to one another, at an angle of 45°.

The mode of operation of the binding tool is as follows: Let it be assumed that the wire guides **25*a*, 25*b* and possibly 25*c*, 25*d* of the binding tool, as shown in FIGS. 1 and 3, are closed and engage round the two rods L and Q to be connected. As soon as the motor 2 is set in operation, it drives the conveying pulley 7 via the main shaft 3 and the worm gear 5 and 6. The projection 38 on the wire guide 25*a* holds the leaf spring 39 tensioned so that the pressure roller 10 is urged against the wire D by the two-armed lever 40. The wire D is therefore pushed between the conveying pulley 7 and the pressure roller 10 into the guide tube 42 and further into the guide nozzle 30 and into the receiving passage 34*a* of the right-hand component 36. When it emerges from the passages 34*a*, the wire D enters the U-shaped channels 27*a*, 27*b* at the inner faces of the wire guides 25*a*, 25*b* which it has to follow, forming a U-shaped loop, until the end of the wire enters the receiving passage 34*b* in the left-hand component 36 and strikes against the stop member 31** behind this.

Since, on the one hand the end of the wire is held by the stop member 31 and on the other hand the wire is continuously confined downstream of the point at which a driving force is exerted thereon between the conveying pulley 7 and the pressure roller 31, so that it cannot escape sideways, the conveying pulley 7 begins to slip on the wire. The conveying pulley 7, and with it the gearwheels 8 and 13 and the camplate 15, continue to rotate until the follower roller 16, which was hitherto on the flattened portion **15*a* of the camplate 15, runs onto the circular peripheral portion of the camplate. At this moment, the levers 17 and 19 are pivoted in clockwise direction and the sliding member 23 and the draw rods 26 begin to move downwards, during which the spring 22 is compressed and tensioned and the wire guides 25*a*, 25*b* open, pivoting in a pincer-like manner about the hinges 24**.

During this opening movement, by means of which the wire guides **25*a*, 25*b* are swung into the position shown in broken lines in FIG. 1, the guide nozzle 30 is swung towards the right in relation to the passage 34*a* in the right-hand component 36. Because of the lever arms 43 of the components 36, which bear against the solid central body of the twisting head 28, the passage 34*a* cannot follow the movement of the guide nozzle 30 and the wire is therefore sheared at the contact face between the guide nozzle 30 and the passage 34*a***.

At the same time, the projection 38 on the wire guide 25a is deflected inwards by the pivotal movement of this wire guide, as a result of which the leaf spring 39 is relaxed. The pressure roller 10 therefore does not exert any more pressure on the binding wire D, as a result of which the frictional force between the binding wire D and the conveying pulley 7 drops to zero. The conveying pulley, which continues to rotate, therefore cannot exert any more feeding power on the binding wire D.

The lower, pincer-like portions of the wire guides 25a, 25b are moved apart to such an extent that the loop of binding wire, bent into U-shape between the two receiving passages 34a, 34b, emerges completely from the channels 27a, 27b at the inner faces of the wire guides 25a, 25b. At the same time, as a result of this opening movement, the lever arms 43 are also released by the guide nozzle 30 and by the stop member 31 so that the components 36 can swing freely inwards about the bearing pins 35 in the sense of bringing their lower passage openings closer together.

During the swivelling motion of the two levers 17 and 19 in clockwise direction, the projection 20 on the lever 17 comes into contact with the upper portion of the clutch 33 towards the end of this movement, as a result of which the two clutch plates are pressed against one another. As a result, the twisting head 28 is set in rotation and the ends of the binding wire projecting beyond the rods L, Q and held in the receiving passages 34a, 34b of the components 36 are twisted together, the originally U-shaped wire loop or wire loops being pulled together tightly round the two rods L and Q and being closed.

As soon as the ends of the binding wire resting in the receiving passages of the components 36 have been pulled out of these passages as a result of the twisting, the motor 2 is stopped and the binding tool can be removed from the rod crossing point because the wire guides 25a, 25b are still open.

If the binding tool is constructed in the form of a simple hand tool, the switching on and stopping of the motor 2 is effected by the operator by hand, but if the tool forms a component of a binding machine, then the motor, which may be an electric motor or a hydraulic motor, is operated directly by machine, in time with the machine.

As soon as the binding tool has again been brought into the working position at the next rod crossing point, the motor 2 is switched on again. Thus all the parts, including the twisting head 28, are again set in motion. The twisting head 28 runs until the follower roller 16 again reaches the flattened portion of the camplate 15, as a result of which the levers 17 and 19 now begin to swing in counterclockwise direction about the shaft 18.

As a result, the pressure of the projection 20 on the clutch 33 is first relieved so that the twisting head comes to a standstill. A detent mechanism of known construction, which is not illustrated, ensures that the twisting head 28 stops in such a position that the wire guide 25a, 25b can close and the binding wire D can again be supplied without hindrance.

Shortly before the termination of the closing movement of the wire guides 25a, 25b, the leaf spring 39 is again tensioned and the pressure roller 10 is again pressed against the binding wire D, as a result of which a length of binding wire is again supplied to the fresh binding point.

Thus the cycle already described begins afresh.

For the sake of completeness, it may be mentioned that in a construction of the binding tool as shown in FIGS. 1 and 2, wherein the rod crossing point is bound with two binding wires, the conveying pulley 7 as well as the pressure roller 10 and the guide tube 42 have to be provided in duplicate, at both sides of the housing 1.

As already mentioned, binding tools of the kind just described can also be used in mesh binding machines, in which case an appropriate plurality of binding tools is disposed in a row, like the welding electrodes in a mesh welding machine.

We claim:

1. A tool for binding an assembly of elements, particularly of crossed reinforcing rods, at least by one binding wire section, comprising:

a support;

means for operatively advancing the binding wire section in a guide path around the assembly, including a pair of guides mounted on said support for movement toward and away from one another between an open and a closed position thereof, and having respective guide surfaces which together confine the binding wire section to said guide path in said closed position;

means for twisting the respective end portions of the binding wire section with one another, including a twisting head accomodated between said guides for rotation relative thereto and having a pair of twisting components, each of which is located adjacent one of said guides, has a passage for receiving one of the respective binding wire end portions, and has an end which opens onto a respective guide surface of said guides, in respective initial positions of said twisting components, and in said closed position of said guides, and means for mounting said twisting components on said twisting head for pivoting relative thereto out of said initial positions during the rotation of said twisting head, for said ends of said passages to approach one another, as the twisting of the respective end portions of the binding wire progresses.

2. A tool according to claim 1, wherein said advancing means includes means for feeding a continuous binding wire through said passage of one of said twisting components onto said guide surface of one of said guides; and further comprising means for severing the binding wire section from the remainder of the binding wire, including a guide nozzle which has an orifice, and which is so connected to said one guide for movement therewith, that said orifice is aligned with said passage of said one twisting component in said initial and closed positions, and so as to shear the binding wire between itself and said one twisting component, as said one guide moves toward said open position.

3. A tool according to claim 1, wherein said advancing means includes means for feeding the binding wire section to said guides, and means for so controlling the operation of said feeding means in dependence on the position of said guides, that said feeding means is energized, while said guides are in said closed positions and deenergized, when said guides are out of said closed position.

4. A tool according to claim 3, wherein said feeding means includes a pulley, a motor for operatively driving said pulley, and means for engaging said binding wire section with said pulley, including a pressure roller mounted on said support for displacement toward and away from said pulley, and a spring so interposed between one of said guides and said pressure roller, as to become tensioned in said closed position of said guides, and to thus urge said pressure roller toward said pulley.

5. A tool according to claim 1, further comprising means for advancing an additional binding wire section in an additional guide path around the assembly, including an additional pair of guides similar to, and offset from said pair of guides; and wherein said twisting means includes means defining an additional pair of passages for the respective end portions of the additional binding wire section.

6. A tool according to claim 5, wherein said guide surfaces of said guides and of said additional guides are parallel to one another.

* * * * *